US006216879B1

(12) United States Patent
Horvath

(10) Patent No.: US 6,216,879 B1
(45) Date of Patent: Apr. 17, 2001

(54) FOLD SOWN SORTING PAN

(76) Inventor: Gabriel Horvath, 5120 Keith Street, Burnaby, BC (CA), V5J 3C2

( * ) Notice: Subject to any disclaimer, the term of this patent is extended or adjusted under 35 U.S.C. 154(b) by 0 days.

(21) Appl. No.: 09/301,740

(22) Filed: Apr. 29, 1999

(51) Int. Cl.[7] ..... B07C 7/04

(52) U.S. Cl. ..... 209/614; 209/702; 209/707; 209/911; 211/104; 211/170; 248/202.1

(58) Field of Search ..... 209/614, 630, 209/702, 703, 707, 911; 211/104, 170; 248/202.1

(56) References Cited

U.S. PATENT DOCUMENTS 4,627,672 * 12/1986 DeBruyn ..... 211/205 X
5,117,982 * 6/1992 Shotthafer et al. ..... 209/702 X
5,308,158 * 5/1994 Vogelgesang et al. ..... 211/170 X

* cited by examiner

*Primary Examiner*—Tuan N. Nguyen

(57) ABSTRACT

A fold down sorting pan for providing a surface for sorting small objects. The fold down sorting pan includes a mounting portion adapted for mounting to a wall or countertop. A support arm is pivotally coupled to the mounting portion. A tube is coupled to a bottom of the support arm. An extension arm extends from the tube. A pan is coupled to the extension arm.

9 Claims, 3 Drawing Sheets

FOLD SOWN SORTING PAN

BACKGROUND OF THE INVENTION

1. Field of the Invention

The present invention relates to sorting pans and more particularly pertains to a new fold down sorting pan for providing a surface for sorting small objects.

2. Description of the Prior Art

The use of sorting pans is known in the prior art. More specifically, sorting pans heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,480,058; U.S. Pat. No. 4,643,316; U.S. Pat. No. 5,117,982; U.S. Pat. No. 3,628,659; U.S. Pat. No. Des. 271,731; and U.S. Pat. No. 1,580,796.

While these devices fulfill their respective, particular objectives and requirements, the aforementioned patents do not disclose a new fold down sorting pan. The inventive device includes a mounting portion adapted for mounting to a wall or countertop. A support arm is pivotally coupled to the mounting portion. A tube is coupled to a bottom of the support arm. An extension arm extends from the tube. A pan is coupled to the extension arm.

In these respects, the fold down sorting pan according to the present invention substantially departs from the conventional concepts and designs of the prior art, and in so doing provides an apparatus primarily developed for the purpose of providing a surface for sorting small objects.

SUMMARY OF THE INVENTION

In view of the foregoing disadvantages inherent in the known types of sorting pans now present in the prior art, the present invention provides a new fold down sorting pan construction wherein the same can be utilized for providing a surface for sorting small objects.

The general purpose of the present invention, which will be described subsequently in greater detail, is to provide a new fold down sorting pan apparatus and method which has many of the advantages of the sorting pans mentioned heretofore and many novel features that result in a new fold down sorting pan which is not anticipated, rendered obvious, suggested, or even implied by any of the prior art sorting pans, either alone or in any combination thereof.

To attain this, the present invention generally comprises a mounting portion adapted for mounting to a wall or countertop. A support arm is pivotally coupled to the mounting portion. A tube is coupled to a bottom of the support arm. An extension arm extends from the tube. A pan is coupled to the extension arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fold down sorting pan apparatus and method which has many of the advantages of the sorting pans mentioned heretofore and many novel features that result in a new fold down sorting pan which is not anticipated, rendered obvious, suggested, or even implied by any of the prior art sorting pans, either alone or in any combination thereof.

It is another object of the present invention to provide a new fold down sorting pan which may be easily and efficiently manufactured and marketed.

It is a further object of the present invention to provide a new fold down sorting pan which is of a durable and reliable construction.

An even further object of the present invention is to provide a new fold down sorting pan which is susceptible of a low cost of manufacture with regard to both materials and labor, and which accordingly is then susceptible of low prices of sale to the consuming public, thereby making such fold down sorting pan economically available to the buying public.

Still yet another object of the present invention is to provide a new fold down sorting pan which provides in the apparatuses and methods of the prior art some of the advantages thereof, while simultaneously overcoming some of the disadvantages normally associated therewith.

Still another object of the present invention is to provide a new fold down sorting pan for providing a surface for sorting small objects.

Yet another object of the present invention is to provide a new fold down sorting pan which includes a mounting portion adapted for mounting to a wall or countertop. A support arm is pivotally coupled to the mounting portion. A tube is coupled to a bottom of the support arm. An extension arm extends from the tube. A pan is coupled to the extension arm.

Still yet another object of the present invention is to provide a new fold down sorting pan that has a tapered open front end that may be oriented downwardly to pour the objects being sorted into a container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
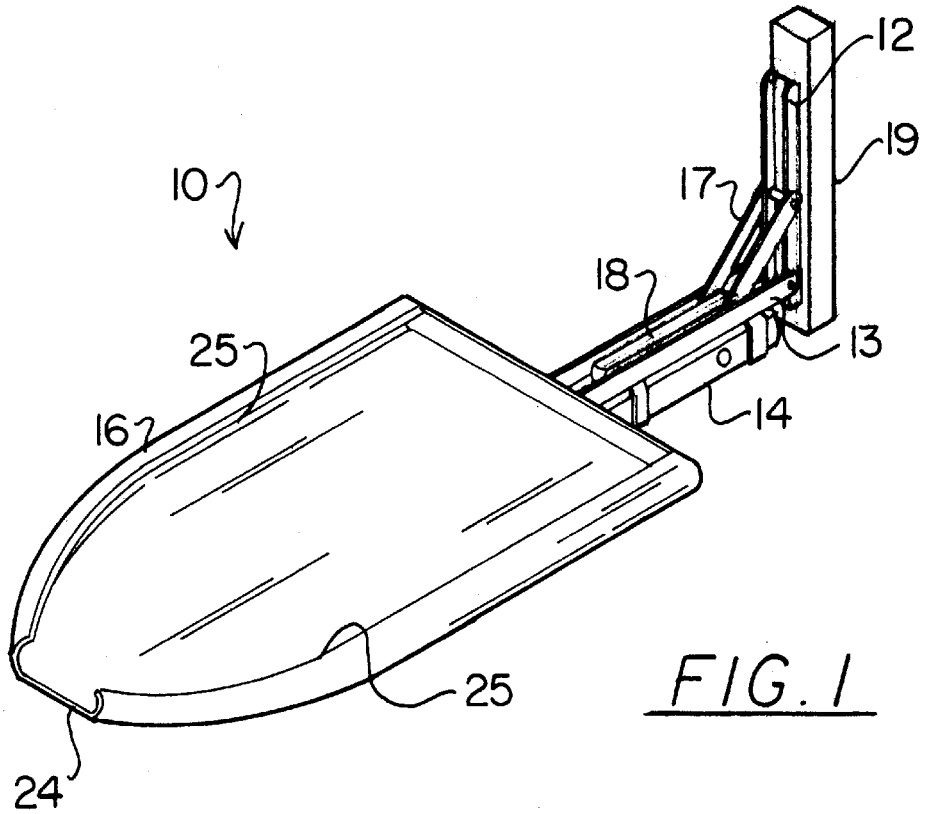
FIG. 1 is a schematic perspective view of a new fold down sorting pan according to the present invention.
Figure 2:
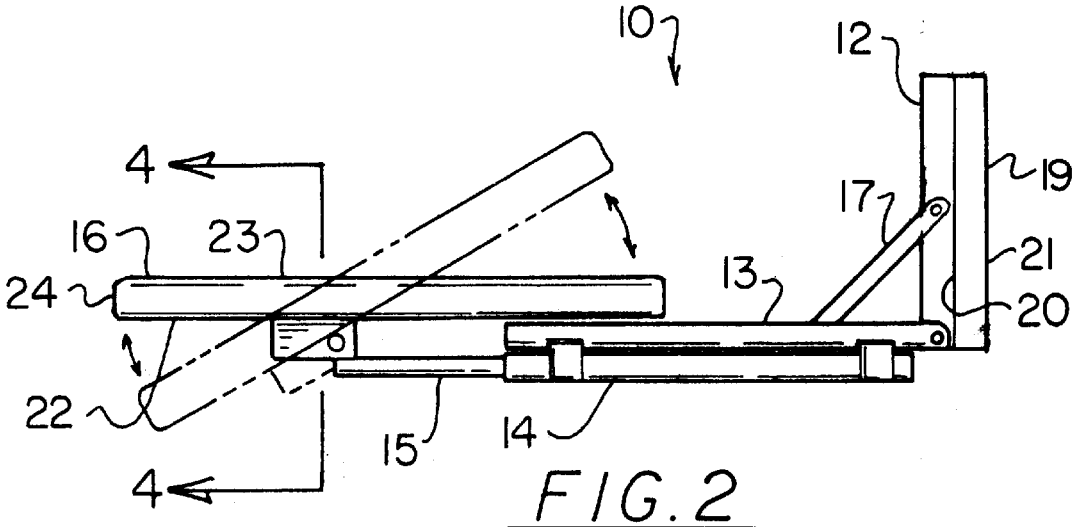
FIG. 2 is a schematic side view of the present invention illustrating the pan in a deployed position.
Figure 3:
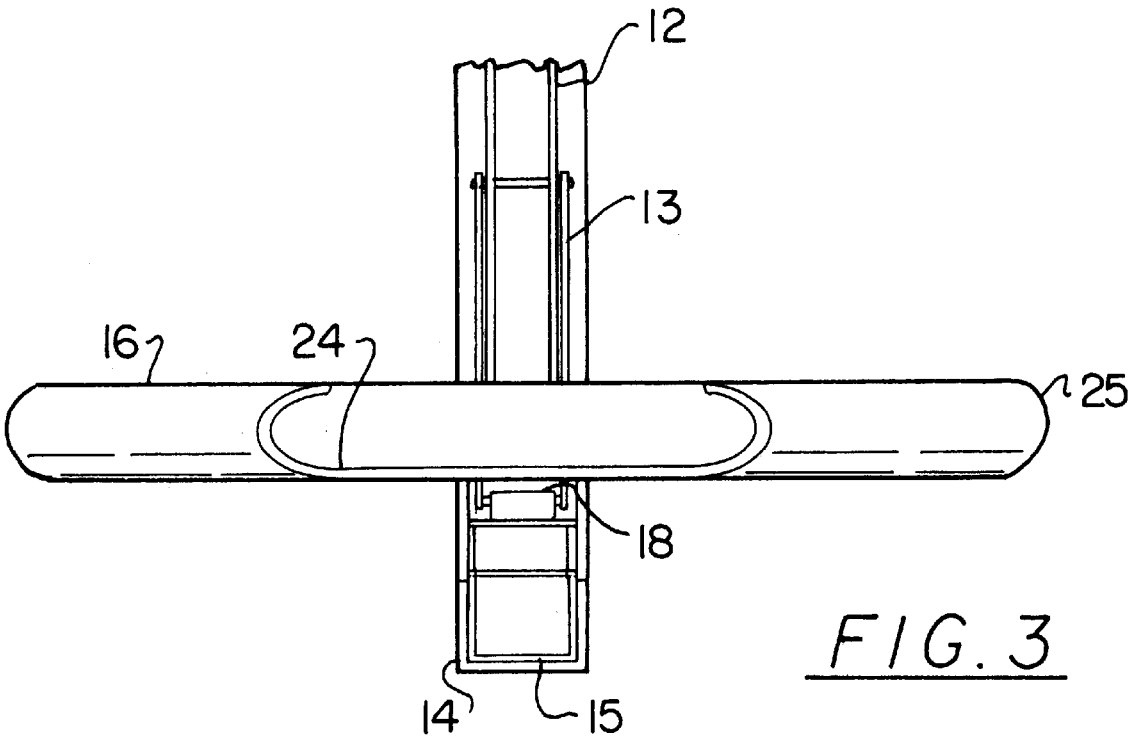
FIG. 3 is a schematic front view of the present invention.
Figure 4:
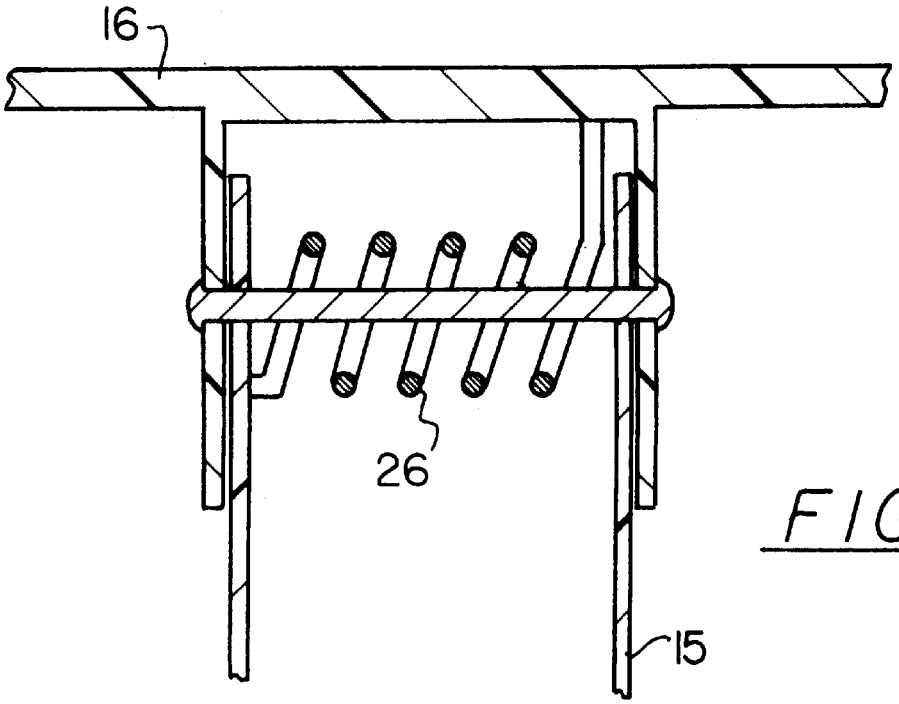
FIG. 4 is a schematic cross sectional view of the present invention taken from line 4—4 of FIG. 2.
Figure 5:
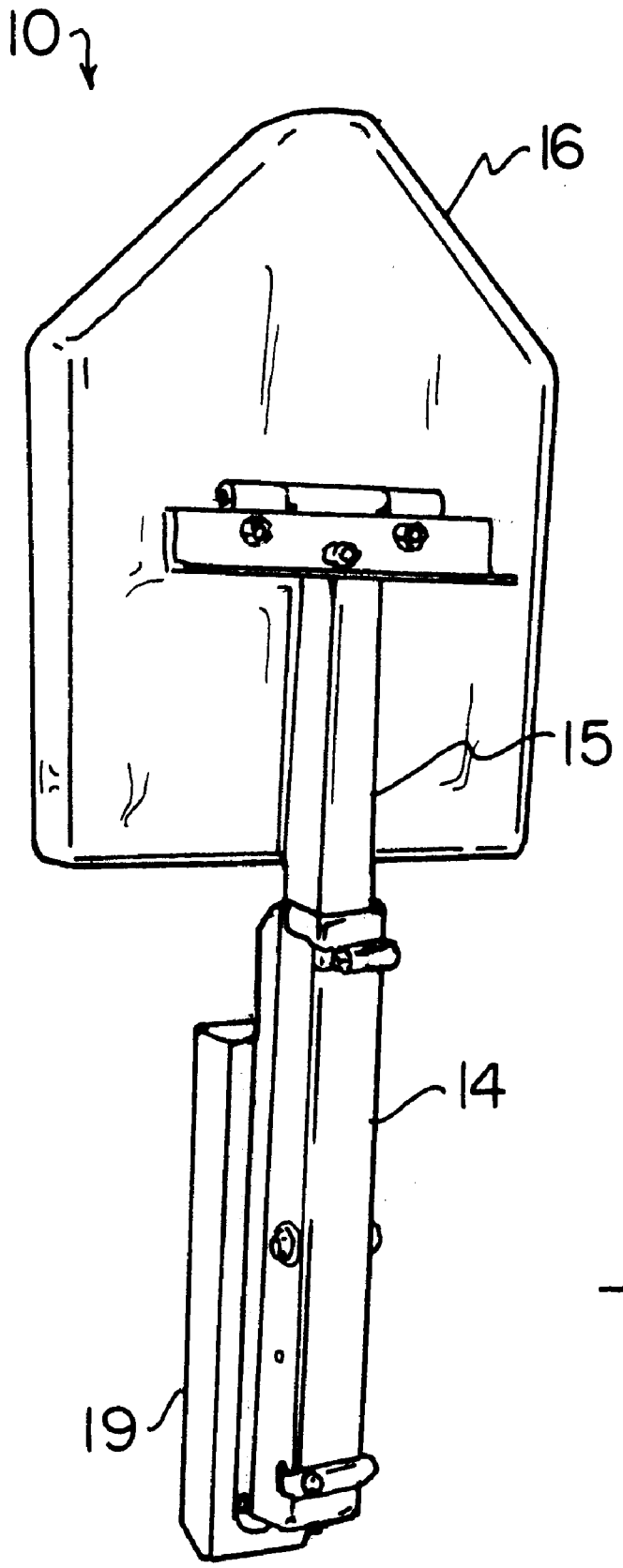
FIG. 5 is a schematic perspective view of the present invention illustrating the pan in a retracted position.

With reference now to the drawings, and in particular to FIGS. 1 through 5 thereof, a new fold down sorting pan embodying the principles and concepts of the present invention and generally designated by the reference numeral 10 will be described.

As best illustrated in FIGS. 1 through 5, the fold down sorting pan 10 generally comprises a mounting portion 12 adapted for mounting to a wall or countertop. A support arm 13 is pivotally coupled to the mounting portion. A tube 14 is coupled to a bottom of the support arm. An extension arm 15 extends from the tube. A pan 16 is coupled to the extension arm.

The support arm is positionable between a deployed position and a retracted position. The support arm is positioned generally horizontally when in the deployed position. The support arm is positioned generally vertically when in the retracted position. The support arm should fit in the mounting portion when in the retracted position.

Preferably, a pair of limiting arms 17 are pivotally coupled to the mounting portion and slidably engage a raised bar 18 of the support arm for limiting pivoting of the support arm away from the mounting portion.

Also preferably, a spacing portion 19 is positioned between the mounting portion and the wall. A width of the spacing portion between front and rear faces 20,21 thereof is greater than a height of the pan between a lower surface 22 and upper rim 23 thereof. The pan is positionable behind the mounting portion such that gravity biases the pan towards a retracted position. See FIG. 5.

Preferably, the extension arm telescopically extends from the tube so that the pan may be extended further from the wall. Ideally, the tube has a generally rectangular transverse cross section, the extension arm has a generally rectangular cross section for preventing rotation of the extension arm with respect to the tube.

Preferably, the pan is pivotally coupled to a free end of the extension arm for permitting dumping of objects from an open front end 24 of the pan. Also preferably, lateral sides 25 of the pan taper together towards the front end of the pan to direct the flow of the objects being poured. Optionally, the lateral sides of the pan curve inwardly. Also optionally, the pivoting of the pan is biased towards a position parallel the extension arm by a spring 26. See FIG. 4.

The preferred dimensions of the pan are about 9 inches long between its front and back ends by about 7½ inches side between its lateral sides. The pan should be constructed of polyethylene plastic so that the objects being sorted slide easily about and off of the pan.

In use, the pan is pulled away from the wall until the support arm is positioned generally perpendicular the wall. The limiting arms stop the support arm in this position. If desired, the pan may be pulled away from the wall to extend the extension arm. Objects are placed in the pan for sorting. The pan may be pivoted to lower its front end to pour the objects out of its open front end. To stow the pan, the pan is lifted towards the wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sorting pan, comprising:

a mounting portion;

a support arm pivotally coupled to said mounting portion;

a tube coupled to a bottom of said support arm;

an extension arm extending from said tube;

a pan coupled to said extension arm; and a pair of limiting arms pivotally coupled to said mounting portion and slidably engaging a raised bar of said support arm for limiting pivoting of said support arm away from said mounting portion.

2. The sorting pan of claim 1, further comprising a spacing portion being positioned between said mounting portion and said wall, a width of said spacing portion between front and rear faces thereof being greater than a height of said pan between a lower surface and upper rim thereof, said pan being positionable behind said mounting portion such that gravity biases said pan towards a retracted position.

3. The sorting pan of claim 1, wherein said extension arm telescopically extends from said tube.

4. The sorting pan of claim 3, wherein said tube has a generally rectangular transverse cross section, said extension arm having a generally rectangular cross section for preventing rotation of said extension arm with respect to said tube.

5. The sorting pan of claim 1, wherein said pan is pivotally coupled to a free end of said extension arm for permitting dumping of objects from an open front end of said pan.

6. The sorting pan of claim 5, wherein lateral sides of said pan tapers together towards said front end of said pan.

7. The sorting pan of claim 1, wherein said lateral sides of said pan curve inwardly.

8. The sorting pan of claim 5, wherein said pan is biased towards a position parallel said extension arm.

9. A sorting pan, comprising:

a mounting portion;

a support arm pivotally coupled to said mounting portion;

a tube coupled to a bottom of said support arm;

an extension arm extending from said tube;

a pan coupled to said extension arm;

a pair of limiting arms pivotally coupled to said mounting portion and slidably engaging a raised bar of said support arm for limiting pivoting of said support arm away from said mounting portion;

a spacing portion being positioned between said mounting portion and said wall, a width of said spacing portion between front and rear faces thereof being greater than a height of said pan between a lower surface and upper rim thereof;

wherein said pan is positionable behind said mounting portion such that gravity biases said pan towards a retracted position;

said extension arm telescopically extending from said tube;

wherein said tube has a generally rectangular transverse cross section, said extension arm having a generally rectangular cross section for preventing rotation of said extension arm with respect to said tube;

wherein said pan is pivotally coupled to a free end of said extension arm for permitting dumping of objects from an open front end of said pan;

lateral sides of said pan tapering together towards said front end of said pan;

wherein said lateral sides of said pan curve inwardly; and said pan being biased towards a position parallel said extension arm.

* * * * *